US005899423A

United States Patent [19]

Albertini

[11] Patent Number: 5,899,423

[45] Date of Patent: May 4, 1999

[54] SUPPORTING STRUCTURE FOR FURNITURE AND THE LIKE COMPRISING AN UPRIGHT WITH LOBES

[75] Inventor: Alberto Albertini, Traversetolo, Italy

[73] Assignee: Coopsette S.C.R.L., Castelnovo Di Sotto (Reggio Emilia), Italy

[21] Appl. No.: 08/893,689

[22] Filed: Jul. 14, 1997

[30] Foreign Application Priority Data

Sep. 11, 1996 [IT] Italy ..... MI96A1864

[51] Int. Cl.[6] ..... A47B 91/00

[52] U.S. Cl. ..... 248/188.8; 108/50

[58] Field of Search ..... 248/188.8, 677, 248/188.1, 188; 108/64, 144.11, 50, 156; 211/27

[56] References Cited

U.S. PATENT DOCUMENTS

| | | | |
|---|---|---|---|
| 2,868,602 | 1/1959 | Drezner | 248/188.8 |
| 3,181,923 | 5/1965 | Guillon et al. | 312/255 |
| 3,309,055 | 3/1967 | Sefcik | 248/188.8 |
| 3,351,313 | 11/1967 | Guillon | 248/188.8 |
| 3,426,110 | 2/1969 | Cheslock | 248/188 |
| 3,747,885 | 7/1973 | Ciancimino | 248/188.1 |
| 3,841,042 | 10/1974 | Siegal | 52/239 |
| 4,021,973 | 5/1977 | Hegg et al. | 52/36 |
| 4,142,343 | 3/1979 | Trafton | 52/721 |
| 4,163,537 | 8/1979 | Mourgue | 248/188.1 |
| 4,941,763 | 7/1990 | Euteneuer | 403/3 |
| 5,174,532 | 12/1992 | Huang | 248/188.1 |
| 5,715,760 | 2/1998 | Frascaroli et al. | 108/50 |

FOREIGN PATENT DOCUMENTS

| | | |
|---|---|---|
| 40 11 374 | 10/1991 | Germany . |
| 40 19 839 | 11/1991 | Germany . |
| 91 11 216 | 1/1992 | Germany . |
| 517 469 | 1/1972 | Switzerland . |
| 657 258 | 8/1986 | Switzerland . |
| 90 07886 | 7/1990 | WIPO . |

*Primary Examiner*—Ramon O. Ramirez
*Assistant Examiner*—Anita M. King
*Attorney, Agent, or Firm*—Herbert Dubno

[57] ABSTRACT

A supporting structure for furniture has at least one upright and at least one bracket which can be attached to the upright. The upright has a cross-section in the form of lobes extending longitudinally along the upright, each pair of adjacent lobes defining a corresponding longitudinal seat. The lobes and seats are designed for coupling with corresponding locking units for respectively positioning the brackets and auxiliary elements complementing the structure.

13 Claims, 3 Drawing Sheets

SUPPORTING STRUCTURE FOR FURNITURE AND THE LIKE COMPRISING AN UPRIGHT WITH LOBES

SPECIFICATION

FIELD OF THE INVENTION

Description

The present invention relates to a supporting structure for furniture and the like comprising at least one upright which has a cross-section with a profile in the form of lobes extending longitudinally over the entire length of the upright, each pair of adjacent lobes defining a corresponding longitudinal seat; each lobe and seat is also designed for coupling with corresponding locking means for positioning brackets supporting surfaces and auxiliary elements complementing the structure

BACKGROUND OF THE INVENTION

In the technical sector of interior furnishing, supporting structures are required which are suitable for forming tables, desks and the like and can be easily assembled, ensuring the necessary rigidity of the assembled components, and which allow several support surfaces to be provided in accordance with the various requirements and which can also be connected together so as to form multiple working units suitable for use by several persons.

In addition to this, it is also required that such structures should be easy to assemble and disassemble and be able to be combined so as to form tables of different dimensions and geometrical configurations without having to vary the elements which make up the supporting structure It is also known that the technical problems associated with these functional requirements have already been considered and solved by three main types of supporting structures.

Conventional solution, where the supporting structures may be jointly used by several accessory elements, as, for example, in the case of adjacent tables, the surfaces are supported by common uprights. In this case, however, extension of the structure is performed only along one axis, i.e. the horizontal one, of the theoretical set of three reference axes defining the volume of the area to be furnished In a combined system, the structures are still jointly used by several working surfaces and, if necessary, by screens separating the actual work stations. In this case the structure may be expanded along all three axes of the aforementioned set of three axes defining the volume to be furnished and allows a large amount of space to be saved compared to the conventional solution. However, it has the drawback that, in order to vary the arrangement of part of the work stations, it is necessary to disassemble the structure by performing operations which, although they are simple, take time and require disassembly of the entire structure which must be then re-assembled with additional parts.

In an add-on system, the latter which is composed of structures for supporting the various components which are totally independent. The multiple configuration is obtained in this case by simply arranging the tables next to one another in the two horizontal directions of the aforementioned set of three reference axes. In this case also, it is possible to obtain an expansion in the vertical direction for screens, accessories and the like, which, however, are joined together without the possibility of relative movement.

All the systems described above are, however, independent of one another and it is not possible to change from one to the other, without modifying entirely the elements which make up the basic structure.

OBJECTS OF THE INVENTION

It is the object of the invention, therefore, to provide a supporting structure for office furniture, such as tables and the like, which allows different types of furniture to be assembled and also arranged alongside one another so as to form multiple work stations, by means of a varying use of the same basic elements which make up the structure.

It is another object to provide a structure which is modular and allows the rapid assembly of the various parts in all three directions—width, height and depth—of the set of three reference axes defining the volume to be furnished, allowing in particular modification of the height, from the ground, of the working surfaces independently of the position of the dividing screens and/or similar accessories completing the structure.

SUMMARY OF THE INVENTION

These objects are achieved according to the present invention by a supporting structure for furniture and the like, comprising at least one upright and at least one bracket which can be attached to the upright. The upright has a cross-section with a profile in the form of lobes extending longitudinally over the entire length of the upright, each pair of adjacent lobes defining a corresponding longitudinal seat. The lobes and seats are designed to be coupled with corresponding locking means for respectively positioning said bracket and auxiliary elements complementing the structure.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
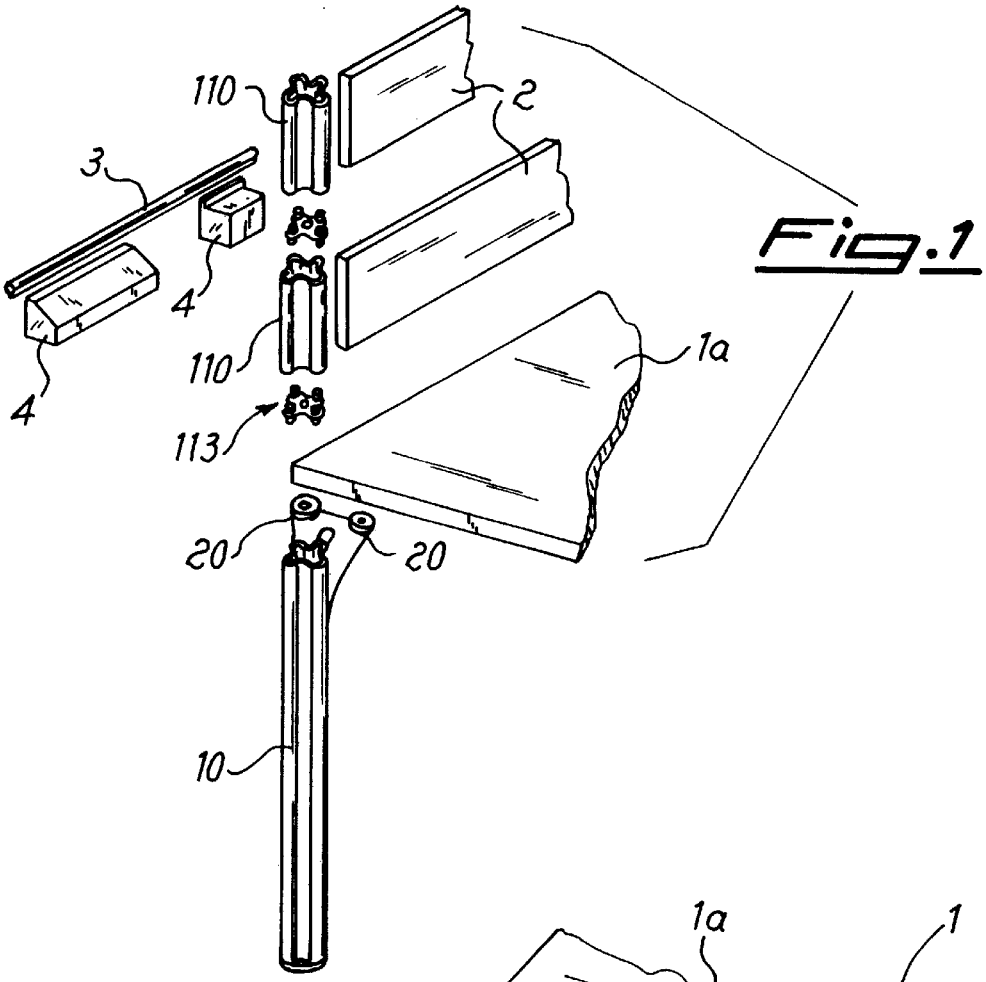
FIG. 1 is an exploded fragmentary perspective view of the basic components of the support structure according to the invention.
Figure 2:
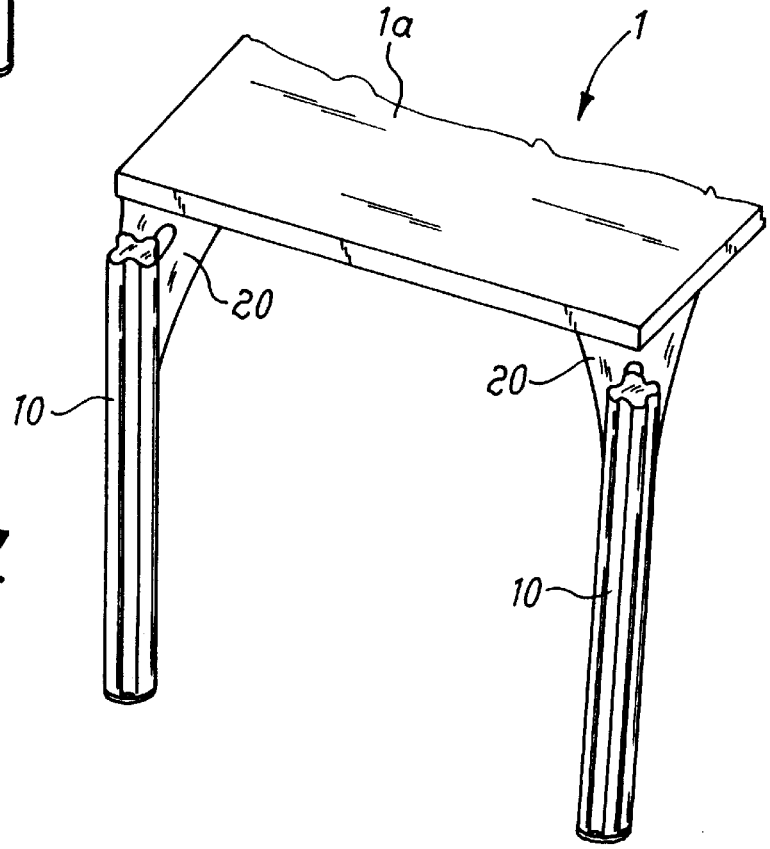
FIG. 2 is a fragmentary perspective view of the support structure according to the invention.

As shown in FIGS. 1 and 2, the support structure according to the invention comprises substantially an upright 10 to which there may be attached brackets 20 designed to support, for example, the surface 1*a* of a table 1.

The uprights 10 may also have coaxially engaged with them extension elements 110 onto which, for example, dividing elements 2 or arms 3 carrying accessories 4 are mounted.

Figure 3:
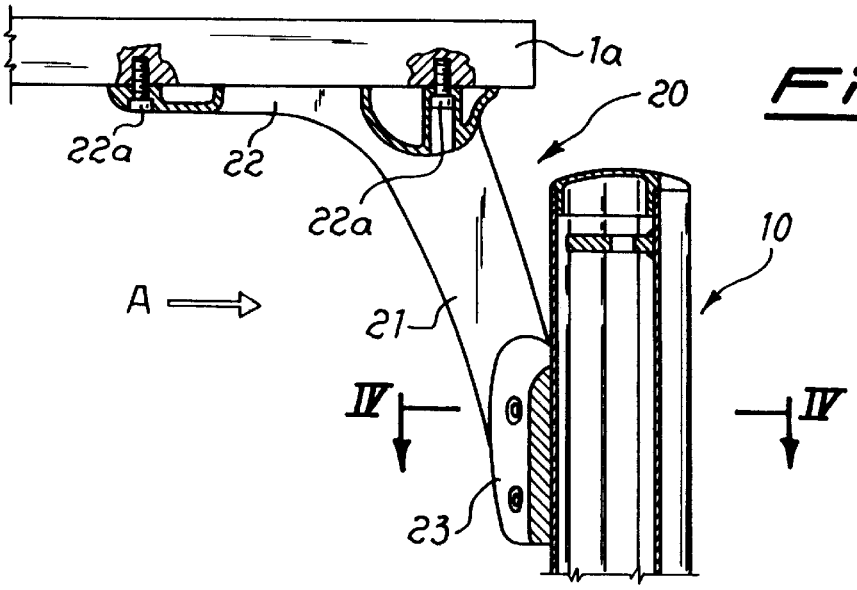
FIG. 3 is a detail view partially in section of the upright and the bracket of the structure according to FIG. 1.

As can be seen from (FIGS. 3, 4 and 5) the uprights 10 consist of a profiled member shaped in the form of lobes 11, extending symmetrically outwards. Each pair of adjacent lobes defines a corresponding longitudinal groove 12 extending over the entire height of the upright itself.

As will emerge from the description. The lobes 11 and the grooves 12 are designed for coupling with the elements supporting the parts which make up the structure More particularly, each lobe 11 may have fixed to it such a bracket 20 which has two substantially vertical arms 21 which are joined at the opposite ends where they form respectively an upper horizontal surface 22 which can be attached to the surface 1*a* of the table by means of screws 22*a* and locking means 23 for fixing the bracket 20 to the upright 10 at the desired height from the ground.

The locking means 23 substantially consist of a clamp comprising a fixed jaw 23*a* joined to the bracket 20, which is provided with a transverse through-hole 23*b* which has inserted inside it a screw 23*c* designed to engage with a female thread 24*a* formed in a movable counter-jaw 24.

In this way operation of the screw 23*c,* inclined to the radial plane (FIG. 4), causes symmetrical tightening of the clamp 23 and consequent fixing of the bracket on the upright 10.

Figure 4:
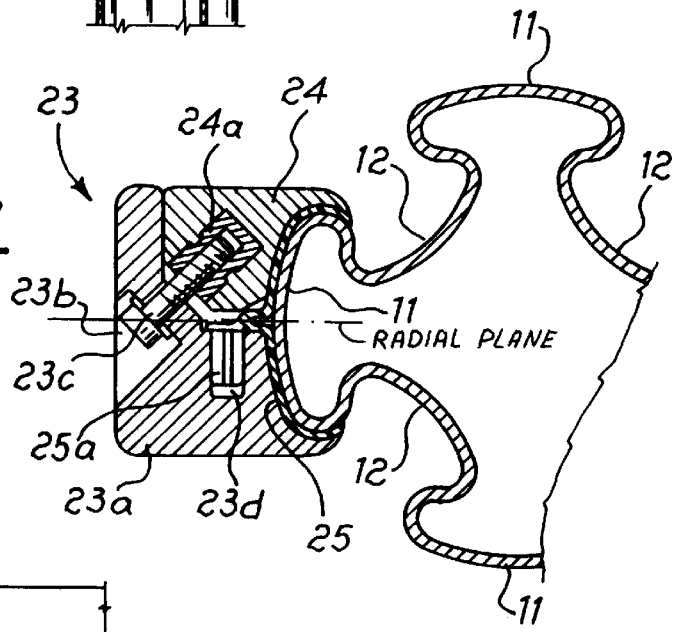
FIG. 4 is a detail section taken along the line IV section along the plane indicated by IV—IV in FIG. 3.
Figure 5:
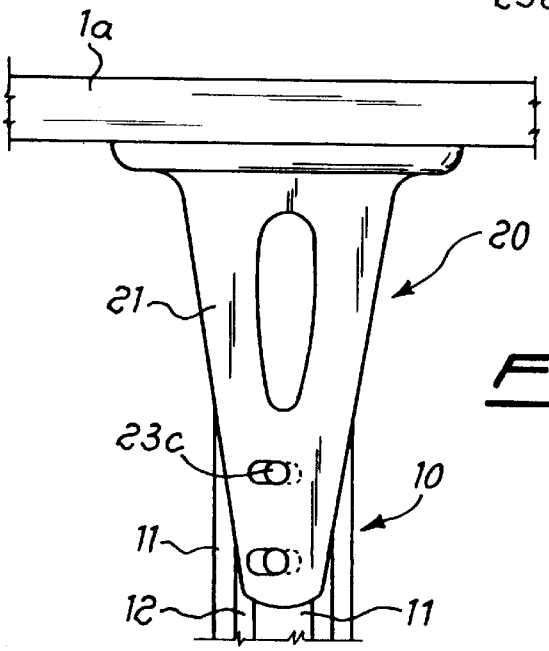
FIG. 5 is an elevational view of the upright and the bracket in the direction of the arrow "A" of FIG. 3.

As shown in FIG. 4, the clamp 23 and the lobe 11 have arranged between them a thin layer 25 of plastic material for protecting the parts which make contact. The layer 25 of plastic material has, moreover, reference extensions 25*a* on which corresponding seats 23*d* of the clamp 23 are positioned for precise positioning and supporting thereof.

Figure 6:
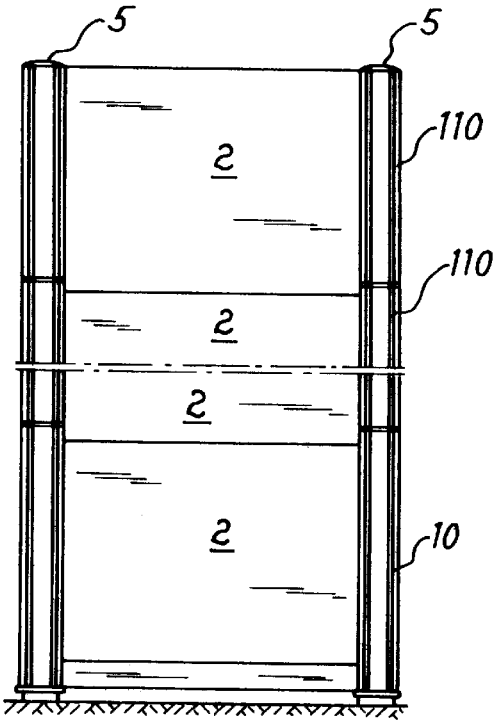
FIG. 6 is a front view of a dividing wall obtained with a structure according to the invention.
Figure 7:
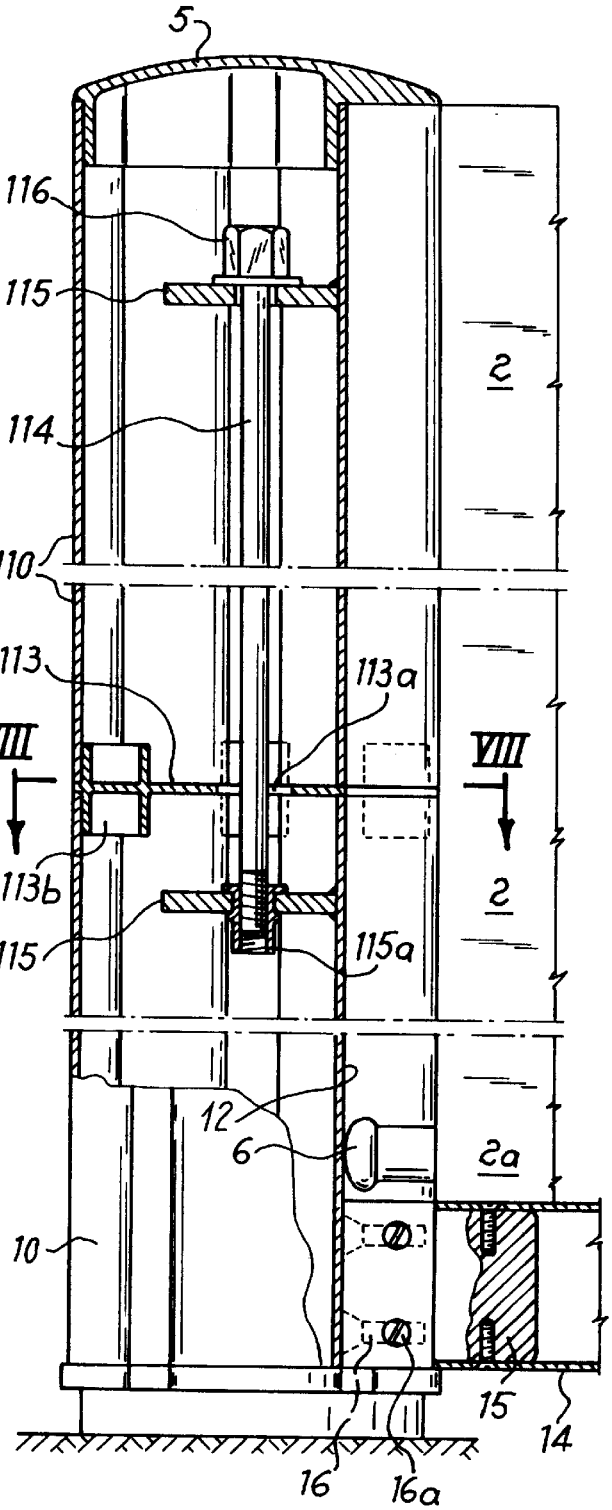
FIG. 7 is a partially sectioned view, on a larger scale, of the upright of the dividing wall according to FIG. 6.
Figure 8:
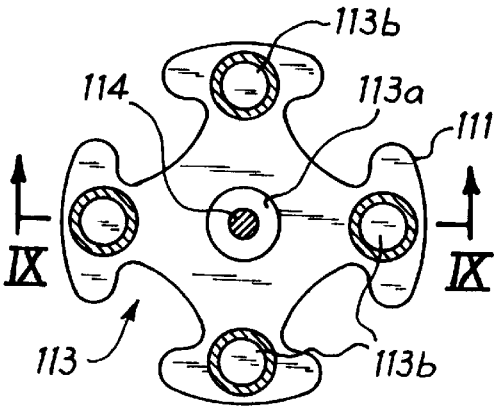
FIG. 8 is a section taken along the line along the plane indicated by VIII—VIII in FIG. 7.
Figure 9:
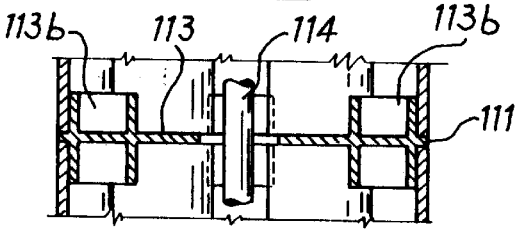
FIG. 9 is a section taken along the line IX—IX in FIG. 8.

Moreover, according to the invention, the structure also allows extension of the work station in the vertical direction (FIGS. 6, 7 and 8). For this purpose extension elements 110 are provided. The elements 110 are coaxially connected together by means of the intervening arrangement of transverse elements 113 having a cross-section with a profile corresponding to that of the upright 10

The transverse elements 113 are provided with a coaxial hole 113*a* and a pin 113*b* formed in each lobe 111 for the precise positioning and the stable coupling of the associated extensions 110 in the vertical direction.

The stable connection and structural rigidity of said extension sections is obtained by means of a tie-rod 114, the opposite ends of which are threaded and respectively designed to engage with a female thread 115*a* formed in a horizontal bracket 115 welded on the inside of the upright 110 and with a lock nut 116, tightening of which against a second bracket 115 results in tensioning of the tie-rod itself.

The open top part of each upright 10, 110 is then closed by a cover-piece 5.

is shown in FIG. 7, inside each longitudinal seat 12 it is possible to insert modular panels 2, the opposite end sections 2*a* of which have coupling means 6 formed in the manner of shaped studs designed to engage with the corresponding seat 12, into which they are inserted from the top in the longitudinal direction. The positioning or locking of the panels is performed either by means of abutment of the upper panel onto the lower panel or, if the latter is absent, by the application of expansion elements which are fitted in the transverse direction onto the seat 12.

In the latter case it is obviously possible to leave empty spaces between one panel and the next, for example so as to allow documents to be passed from work station to the other.

According to the invention (FIG. 7) it is also envisaged that a base-piece 14 may be fitted to the bottom end of the upright 10, said base-piece being attachable to the seat 12 by means of a joint 15 which is locked in position by means of transverse pins 16 which can be translatably operated in the transverse direction by means of eccentric screws 16*a* which cause expansion of the joint in the seat 12 and hence locking thereof in position.

The supporting structure according to the invention thus allows the assembly of a large variety of furniture of a different type by means of a few basic modular elements, thereby also making it possible to expand the basic configuration in all the directions of the set of three reference axes of the volume to be furnished either with combined use of supporting elements or by means of the simple arrangement next to one other of mutually independent parts.

In addition, as a result of the structure according to the invention it is also possible to adjust with continuity the height of the various parts such as surfaces, brackets and dividing walls without necessarily having to act on the other parts of the same configuration as well.

I claim:

1. A support structure for an article of furniture, comprising:

an upright having in cross section a plurality of lobes extending the full length of said upright and defining longitudinal grooves between them also extending the full length of said upright, each of said lobes being shaped so as to be symmetrical to a radial plane of said upright; and at least one bracket secured to said upright and comprising a leg extending toward a respective one of said lobes, and a clamp securing said leg to said lobe, said clamp comprising a first clamp jaw fixed to said leg and shaped to fit partly around said one of said lobes, a second clamp jaw movable on said bracket, juxtaposed with said first clamp jaw and shaped to fit partly around said one of said lobes, and at least one tightening screw traversing one of said jaws and threaded into the other of said jaws and inclined to a respective radial plane of said upright at said one of said lobes.

2. The support structure defined in claim 1 wherein said lobes have rounded profiles.

3. The support structure defined in claim 1 wherein said grooves have rounded profiles.

4. The support structure defined in claim 1 wherein said clamp jaws have rounded recesses on opposite sides of a separation between said jaws for engaging around said one of said lobes.

5. The support structure defined in claim 4, further comprising a layer of a protective material between said jaws and said one of said lobes.

6. The support structure defined in claim 5 wherein said layer has a portion extending between said jaws.

7. The support structure defined in claim 1, further comprising a panel having an element shaped to be received in one of said grooves upon axial insertion of said element from an end of said upright.

8. The support structure defined in claim 7, further comprising a member forming a base piece for said panel and comprising transverse pins received in a respective one of said grooves and translatable by an eccentric.

9. The support structure defined in claim 1 further comprising connecting means for securing extension sections to said upright.

10. The support structure defined in claim 9 wherein said connecting means comprises a transverse element having a cross section corresponding to that of the upright and provided with a coaxial hole and a pin formed in each lobe for precise positioning of a respective one of said extensions.

11. The support structure defined in claim 10 further comprising a tie rod for securing said extension to said upright.

12. A support structure for an article of furniture, comprising:

an upright having in cross section a plurality of lobes extending the full length of said upright and defining longitudinal grooves between them also extending the full length of said upright; and at least one bracket secured to said upright and comprising a leg extending toward a respective one of said lobes, a clamp securing said leg to said lobe, said clamp comprising a first clamp jaw fixed to said leg and shaped to fit partly around said one of said lobes, a second clamp jaw movable on said bracket, juxtaposed with said first clamp jaw and shaped to fit partly around said one of said lobes, and at least one tightening screw traversing one of said jaws and threaded into the other of said jaws, and a layer of a protective material between said jaws and said one on said lobes, said layer having a transverse relief fitting into a seat formed in one of said jaws.

13. A support structure for an article of furniture, comprising:

an upright having in cross section a plurality of lobes extending the full length of said upright and defining longitudinal grooves between them also extending the full length of said upright, each of said lobes being shaped so as to be symmetrical to a radial plane of said upright; and at least one bracket secured to said upright and comprising a leg extending toward a respective one of said lobes, a clamp securing said leg to said lobe, said clamp comprising a first clamp jaw fixed to said leg and shaped to fit partly around said one of said lobes, a second clamp jaw movable on said bracket, juxtaposed with said first clamp jaw and shaped to fit partly around said one of said lobes, and at least one tightening screw traversing one of said jaws and threaded into the other of said jaws and inclined to a respective radial plane of said upright at said one of said lobes, and a layer of a protective material between said jaws and said one on said lobes, said layer having a transverse relief fitting into a seat formed in one of said jaws.

* * * * *